US006818121B2

(12) United States Patent
Mori et al.

(10) Patent No.: US 6,818,121 B2
(45) Date of Patent: Nov. 16, 2004

(54) PRODUCTION PROCESS OF INDENE

(75) Inventors: Hiroaki Mori, Tokyo (JP); Youko Sugio, Tokyo (JP)

(73) Assignee: JFE Chemical Corporation, Tokyo (JP)

( * ) Notice: Subject to any disclaimer, the term of this patent is extended or adjusted under 35 U.S.C. 154(b) by 858 days.

(21) Appl. No.: 09/768,284

(22) Filed: Jan. 25, 2001

(65) Prior Publication Data

US 2001/0023819 A1 Sep. 27, 2001

(30) Foreign Application Priority Data

Jan. 26, 2000 (JP) ..... 2000-021737

(51) Int. Cl.[7] ..... B01D 3/04; B01D 3/36; C01G 21/12; C01G 29/20; C01G 7/08

(52) U.S. Cl. ..... 208/313; 208/290; 208/245 R; 208/322; 203/63; 203/57; 585/833

(58) Field of Search ..... 208/313, 290, 208/254 R, 322; 203/57, 63; 585/833

(56) References Cited

U.S. PATENT DOCUMENTS 2,279,780 A * 4/1942 Engel ..... 203/48
4,349,418 A * 9/1982 Belsky et al. ..... 203/45
5,964,987 A * 10/1999 Duncan et al. ..... 203/51

FOREIGN PATENT DOCUMENTS

EP 1132452 A2 * 9/2001 ..... C10C/1/08
JP 360087230 A * 5/1985

* cited by examiner

*Primary Examiner*—Walter D. Griffin
*Assistant Examiner*—Tam Nguyen
(74) *Attorney, Agent, or Firm*—Oblon, Spivak, McClelland, Maier & Neustadt, P.C.

(57) ABSTRACT

Indene is produced from an indene-containing coal tar distillate by adding a glycol to the indene-containing coal tar distillate and then conducting azeotropic distillation to obtain an indene fraction while eliminating benzonitrile from the indene-containing coal tar distillate.

6 Claims, 1 Drawing Sheet

PRODUCTION PROCESS OF INDENE

BACKGROUND OF THE INVENTION a) Field of the Invention

This invention relates to a process for producing indene from an indene-containing coal tar distillate, and more specifically to a process for producing high-purity indene by adding a glycol or a derivative thereof (hereinafter simply called "a glycol") to an indene-containing coal tar distillate and then conducting azeotropic distillation to have practically indene alone distilled selectively while allowing benzonitrile to concentrate in a bottoms residual or by adding a glycol or a particular extractant and then conducting extractive distillation to have practically indene alone distilled selectively while allowing benzonitrile to concentrate in a bottoms residual.

b) Description of the Related Art

An indene-containing distillate available from distillation of a coal tar distillate contains components hardly separable from indene by distillation. Additional purification procedures are needed to purify indene further. Impurities in such an indene distillate include inter alia benzonitrile, indane, alkylbenzenes, oxygen-containing organic compounds such as phenols, and nitrogen-containing organic compounds such as pyridines and anilines. It is known that among these, phenols, pyridines and anilines can be eliminated by treatment with an aqueous alkali or acid solution. Further, indane can be eliminated by precision distillation. Benzonitrile and alkylbenzenes, however, cannot be eliminated even when treated with an aqueous acid or alkali solution. Even if precision distillation is conducted, they cannot be separated satisfactorily.

Known conventional processes for the elimination of benzonitrile from an indene distillate include: a process for eliminating benzonitrile as a benzoate salt by hydrolyzing benzonitrile under heat in an aqueous alkali solution (JP 09-301898 A); a process for azeotropically eliminating benzonitrile by adding furfural or n-hexanol; a process making use of adsorptive separation; a crystallization process; and a process for azeotropically distilling benzonitrile by adding a phenol, an alcohol, an amine or the like (U.S. Pat. No. 2,279,780, JP 60-87230 A).

However, the process which features hydrolysis of benzonitrile requires use of an aqueous alkali hydroxide solution of high concentration and treatment for long time at high temperature. Moreover, the resulting benzoate leads to formation of an aqueous emulsion, handling of which is difficult. The process making use of adsorptive separation is not suited for the treatment of a great deal of feed. The process which relies upon crystallization is extremely difficult for actual practice from the standpoint of industrial scale, treatment of a great deal of feed (indene-containing coal tar distillate) and cost.

Further, the azeotropic distillation process disclosed in U.S. Pat. No. 2,279,780 azeotropically eliminates light components other than indene by incorporating a compound, which contains one or more polar groups such as hydroxyl groups, carboxyl groups or amino groups, as an additive in a coal tar distillate and then conducting precision distillation. According to this process, the components having lower boiling points than indene are firstly eliminated together with the polar additive from the top of a distillation column in an initial stage of the distillation, and subsequent to distillation of indene and the additive, components heavier than indene are obtained as a bottoms residual. This process is, however, not fully effective from the viewpoint of elimination of benzonitrile. Moreover, the additive is contained in the respective distillate fractions and the bottoms residual, and in view of the need for recycled use of the additive, this process is not considered to be readily usable in practice.

According to the process disclosed in JP 60-87230 A, on the other hand, a phenol is added to a coal tar distillate, and indene and the phenol are then azeotropically distilled while allowing components heavier than indene, such as benzonitrile, to obtain as a bottoms residual. In this process, the concentration of indene in the azeotropic distillate is certainly higher than that of indene in the coal tar distillate before the azeotropic distillation. Nonetheless, the azeotropic distillate contains the phenol at a considerably high concentration. For the production of high-purity indene, addition of the phenol in a large amount as an entrainer is indispensable although the phenol can be extracted in an aqueous alkali solution. Accordingly, to treat the phenol in the distillate recovered by the distillation, the treatment with the aqueous alkali solution results in a substantial load. Moreover, post treatment of the waste alkali leads to a further problem.

No satisfactory process is, therefore, considered to have been established yet for the elimination of benzonitrile from indene.

SUMMARY OF THE INVENTION

Therefore, an object of the present invention is to overcome the above-described problems of the conventional art and hence, to provide a process for the production of indene, which makes it possible to easily obtain high-purity indene.

The above-described object can be achieved by the present invention to be described hereinafter.

In a first aspect of the present invention, there is thus provided a process for producing indene, which comprises adding a glycol or a derivative thereof to an indene-containing coal tar distillate, and then conducting azeotropic distillation to obtain an indene fraction while eliminating benzonitrile from the indene-containing coal tar distillate.

In a second aspect of the present invention, there is also provided a process for producing indene, which comprises adding a glycol or a derivative thereof to an indene-containing coal tar distillate, and then conducting extractive distillation to obtain an indene fraction while eliminating benzonitrile from the indene-containing coal tar distillate.

In a third aspect of the present invention, there is also provided a process for producing indene, which comprises adding to an indene-containing coal tar distillate an extractant selected from the group consisting of dialkyl carbonates, alkylene carbonates and diaryl carbonates, and then conducting extractive distillation to obtain an indene fraction while eliminating benzonitrile from the indene-containing coal tar distillate.

According to the first aspect of the present invention, the azeotropic distillation of the indene-containing coal tar distillate in the presence of the glycol can effectively change the volatility of benzonitrile, that is, can form an azeotrope of the glycol and indene, whereby practically indene alone can be selectively distilled to obtain high-purity indene. When ethylene glycol is used as an illustrative glycol here, an azeotrope is formed with indene and ethylene glycol so that indene is recovered as a low boiling-point fraction while benzonitrile is allowed to concentrate as a high boiling-point fraction in a bottoms residual.

According to the second or third aspect of the present invention, on the other hand, the extractive distillation of the indene-containing coal tar distillate in the presence of the glycol or extractant can effectively change the volatility of benzonitrile, that is, can effectively extract benzonitrile owing to the addition of the glycol or extractant, whereby practically indene alone can be distilled to obtain high-purity indene. When triethylene glycol is used as an illustrative glycol or ethylene carbonate is employed as an illustrative extractant, practically indene alone is distilled, and components heavier than indene are recovered together with triethylene glycol or ethylene carbonate as a bottoms residual.

DETAILED DESCRIPTION OF THE INVENTION AND PREFERRED EMBODIMENTS

Figure 1:
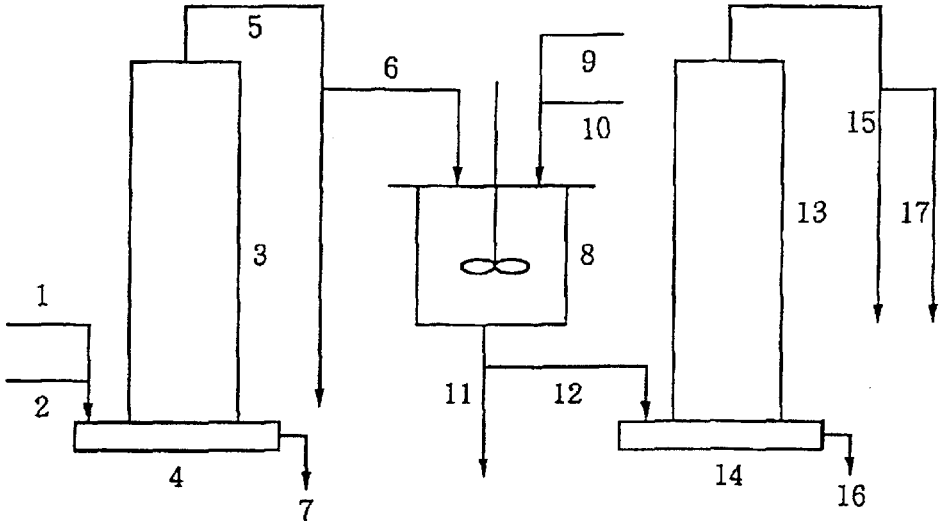
FIG. 1 is a flow sheet showing a production process of indene according to the first aspect of the present invention.

The present invention will next be described more specifically based on preferred embodiments. Examples of the coal tar distillate for use in the present invention can include distillate from coke-oven gas oil; gas oil, middle oil and carbolic oil available from distillation of coal tar; and those obtained with higher indene concentrations from these distillate and oils. Acid and base components contained in these distillate and oils, such as phenols, pyridines and anilines, may be or may not be eliminated beforehand by acid washing and alkali washing. In the first aspect of the present invention, inclusion of a washing step as a post-distillation step is desired for the full elimination of the glycol where the glycol is contained in a trace amount in the distilled indene. It is not particularly necessary to eliminate other impurities in advance unless they interfere with the distillation.

Usable examples of the glycol for use in the first aspect of the present invention can include glycols such as ethylene glycol, diethylene glycol, propanediol and butanediol; glycol monoalkyl ethers, such as ethylene glycol monomethyl ether, diethylene glycol monomethyl ether; other glycols; and mixtures thereof. Among these, particularly preferred is ethylene glycol. When ethylene glycol is used, ethylene glycol forms an azeotrope with indene so that indene can be recovered as an ethylene glycol-indene distillate.

The recovered distillate can readily undergo liquid-liquid separation, because it separates into an indene layer and an ethylene glycol layer. As the indene layer contains only a trace amount of ethylene glycol, the ethylene glycol in the indene can be completely eliminated through conventional post-distillation steps, that is, by acid washing and alkali washing. In the ethylene glycol layer, on the other hand, indene is dissolved at a concentration of 10 wt. % or so. This ethylene glycol layer can be recycled, as is, to a distillation column. The glycol may be added in a proportion of 3 wt. % or higher, preferably of from 5 to 200 wt. % based on the indene-containing distillate as a feed.

Illustrative of the glycol employed as an extractant in the second aspect of the present invention are glycols such as triethylene glycol and tetraethylene glycol; glycol monoalkyl ethers such as triethylene glycol monomethyl ether and tetraethylene glycol monomethyl ether; other glycols; and mixtures thereof. Of these, particularly preferred is tetraethylene glycol. These glycols can lower the relative volatility of benzonitrile, whereby practically indene alone can be distilled and as a bottoms residual, benzonitrile and tri- or tetraethylene glycol can be recovered.

As the recovered indene distillate does not contain tri- or tetraethylene glycol, absolutely no post-treatment step is needed except for conventional post-distillation steps, namely, acid washing and alkali washing. In the bottoms residual, on the other hand, components heavier than indene, led by benzonitrile, and tri- or tetraethylene glycol remain. It is therefore possible to recover triethylene glycol from the bottoms residual by distillation and to use it again as the extractant. The glycol may be added in a proportion of 3 wt. % or higher, preferably of from 5 to 200 wt. % based on the indene-containing coal tar distillate as a feed.

As has been described above, the distillation of the indene-containing coal tar distillate—a feed containing benzonitrile as a principal impurity—subsequent to the addition of the above-described glycol makes it possible to obtain an indene distillate with the content of benzonitrile lowered significantly. In this indene distillate, acid and base components originated from coal tar are still mixed. These components can be eliminated by a known process, namely, by acid washing and alkali washing.

Illustrative of the extractant employed in the third aspect of the present invention are dimethyl carbonate, ethylene carbonate, propylene carbonate, diphenyl carbonate, and mixtures thereof. Of these, particularly preferred is ethylene carbonate. When ethylene carbonate is used, ethylene carbonate lowers the relative volatility, so that practically indene alone can be distilled and as a bottoms residual, benzonitrile and ethylene carbonate can be recovered.

As the recovered indene distillate does not contain ethylene carbonate, absolutely no post-treatment step is needed except for the conventional post-distillation steps, namely, acid washing and alkali washing. In the bottoms residual, on the other hand, components heavier than indene, led by benzonitrile, and ethylene carbonate remain. It is therefore possible to recover ethylene carbonate from the bottoms residual by distillation and to use it again as the extractant. The extractant may be added in a proportion of 3 wt. % or higher, preferably of from 5 to 200 wt. % based on the indene-containing coal tar distillate as a feed.

As has been described above, the distillation of the indene-containing coal tar distillate—a feed containing benzonitrile as a principal impurity—subsequent to the addition of the above-described extractant makes it possible to obtain an indene distillate with the content of benzonitrile lowered significantly. In this indene distillate, acid and base components originated from coal tar are still mixed. These components can be eliminated by a known process, namely, by acid washing and alkali washing.

Referring now to FIG. 1, the process according to the first aspect of the present invention will be described. In this process, high-purity indene is produced from a benzonitrile-containing indene distillate by adding ethylene glycol as an illustrative glycol. In FIG. 1, azeotropic distillation is conducted by charging the indene-containing coal tar distillate and ethylene glycol, an entrainer, into a still pot 4 of a batch distillation column 3 through a line 1 and a line 2, respectively. A light fraction is firstly distilled out through a line 5, and an azeotropic distillate fraction which is distilled out next and comprises indene and the glycol (indene alone in some instances) is collected through a line 6. A majority of benzonitrile remains as a bottoms residual and is discharged through a line 7. An azeotropic distillate fraction of indene and the glycol is charged through a line 6 into a washing tank 8 equipped with an agitator.

Here, the ethylene glycol which has been azeotropically distilled out together with the indene during the distillation is allowed to undergo phase separation from the indene. By conducting phase-phase separation or extraction, the ethylene glycol can be recovered and reused through the line 2. The indene is then treated with an aqueous alkali solution, such as an aqueous solution of sodium hydroxide, supplied through a line 9 and also with water or an aqueous acid solution supplied through a line 10 such that acid components and alkaline components are successively eliminated. After waste washings are drained through a line 11, the indene is charged through a line 12 into a still pot 14 of a batch distillation column 13 and is subjected to precision distillation there. Light fractions are eliminated through a line 15, heavy fractions are eliminated through a line 16, and high-parity indene is recovered through a line 17.

Figure 2:
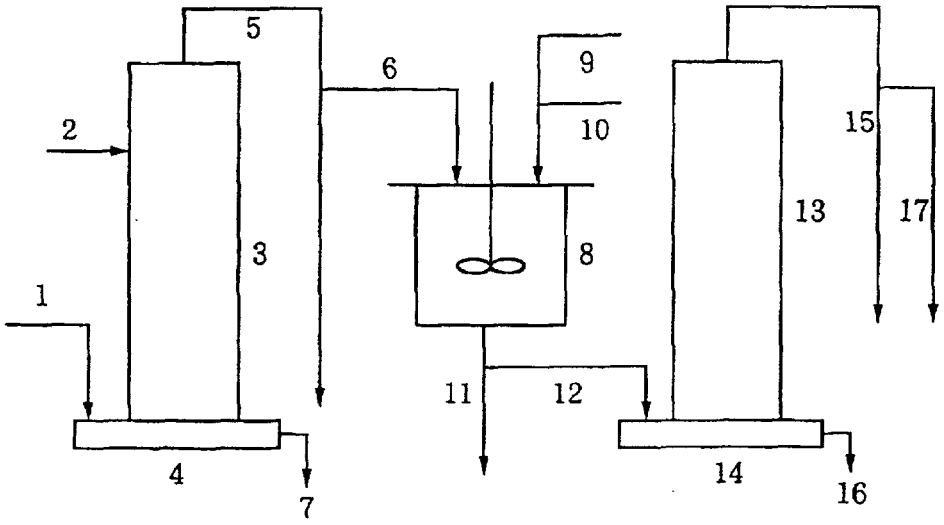
FIG. 2 is a flow sheet illustrating a production process of indene according to the second aspect of the present invention.

With reference to FIG. 2, a description will hereinafter be made of the process according to the second aspect of the present invention. In this process, high-purity indene is produced from a benzonitrile-containing indene distillate by adding, for example, triethylene glycol as an extractant to the indene distillate. This process is suited for producing indene on a relatively small scale. It is an advantageous process especially when existing facilities for treating phenols with a sodium salt are usable.

In FIG. 2, extractive distillation is conducted by charging an indene-containing coal tar distillate through a line 1 into a still pot 4 of a batch distillation column 3 and also charging triethylene glycol (extractant) through a line 2 arranged at a higher stage than the line 1. A light fraction is firstly distilled out through a line 5, and a fraction which is next distilled out and comprises indene as a principal component is collected through a line 6. A majority of benzonitrile remains as a bottoms residual, and is discharged through a line 7. At this time, triethylene glycol also remains in the bottoms residual. The bottoms residual is recovered and distilled to separate the triethylene glycol and benzonitrile from each other. The triethylene glycol can then be charged again through the line 2. The indene fraction is charged through the line 6 into a washing tank 8 which is equipped with an agitator. The indene is treated with an aqueous alkali solution, such as an aqueous solution of sodium hydroxide, supplied through a line 9 and also with water or an aqueous acid solution supplied through a line 10 such that acid components and alkaline components are successively eliminated. After waste washings are drained through a line 11, the indene is charged through a line 12 into a still pot 14 of a batch distillation column 13 and is subjected to precision distillation there. Light fractions are eliminated through a line 15, heavy fractions are eliminated through a line 16, and high-purity indene is recovered through a line 17.

The process depicted in FIG. 2 can also be applied to the third aspect of the present invention to produce high-purity indene from a benzonitrile-containing indene distillate by adding a particular extractant. Like the second aspect of the present invention, this process is suited for producing indene on a relatively small scale. It is an advantageous process especially when existing facilities for treating phenols with a sodium salt are usable.

Referring again to FIG. 2, distillation is conducted while charging an indene-containing coal tar distillate through the line 2 into the still pot 4 of the batch distillation column 3 and charging an extractant such as ethylene carbonate through the line 2 arranged at the higher stage than the line 1. Firstly, a light fraction is distilled out through the line 5, and a fraction which is distilled out next and comprises indene as a principal component is collected through the line 6. A majority of benzonitrile remains as a bottoms residual, and is discharged through the line 7. At this time, the extractant such as ethylene carbonate also remains in the bottoms residual. The bottoms residual is recovered and distilled to separate the extractant and benzonitrile from each other. The extractant can then be charged again through the line 2. The indene fraction is charged through the line 6 into the washing tank 8 which is equipped with the agitator.

The indene is treated with an aqueous alkali solution, such as an aqueous solution of sodium hydroxide, supplied through the line 9 and also with water or an aqueous acid solution supplied through the line 10 such that acid components and alkali components are successively eliminated. After waste washings are drained through the line 11, the indene is charged through the line 12 into the still pot 14 of the batch distillation column 13 and is subjected to precision distillation there. Light fractions are eliminated through the line 15, heavy fractions are eliminated through the line 16, and high-purity indene is recovered through the line 17.

The present invention will hereinafter be described in detail based on Examples and Comparative Examples. It is however to be noted that the present invention shall not be limited by them. All designations of "%" in the following Examples and Comparative Example are on a weight basis unless otherwise specifically indicated.

[First Aspect of the Present Invention]

EXAMPLE 1

To an indene distillate which had been obtained from coal tar heavy oil and contained 94% of indene and 4.8% of benzonitrile, an equiamount of ethylene glycol was added, and reduced-pressure distillation was then conducted under the following conditions: reduced pressure: 50 torr, the number of stages: 15, reflux rate: 10. Distillate was collected as 10% fractions based on the total charge. After indene and ethylene glycol were subjected to phase separation, the indene phase was recovered, and indene, benzonitrile and ethylene glycol contained in the indene phase were quantitated. The results are shown in Table 1. It was found from the results that, although more benzonitrile is generally distilled as the recovered amount of indene increases, the formation of an azeotrope with ethylene glycol and indene made it possible to achieve preferential distillation of indene while suppressing distillation of benzonitrile. As a consequence, substantially no benzonitrile was distilled in a distillate rate range of from 10 to 50% based on the total charge.

EXAMPLE 2

To an indene distillate which had been obtained from coal tar heavy oil and contained 92.1% of indene and 5.83% of benzonitrile, diethylene glycol was added, and reduced pressure distillation was conducted under the same conditions as in Example 1. Indene, benzonitrile and ethylene glycol, which were contained in an indene phase in an azeotropic distillate, were quantitated. The results are shown in Table 1. It is appreciated from the results that substantially no benzonitrile was contained in the fractions of distillate rates of from 10 to 50%.

EXAMPLE 3

To a heavy oil (the composition of which is described in Table 2) which had been obtained from coke-oven gas oil, ethylene glycol was added, and reduced pressure distillation was conducted under the same conditions as in Example 1. As the resulting indene fraction was in a form separated in an indene phase and an ethylene glycol phase, the ethylene glycol phase was removed, and the indene phase was washed with a 10% aqueous solution of sodium hydroxide and then with water. The indene phase was then subjected to atmospheric simple distillation, whereby purified indene was obtained. The compositions of the feed, the intermediate (indene fraction), the alkali-washed indene fraction and the purified indene (finished distillate fraction) were analyzed. The results are shown in Table 2.

EXAMPLE 4

In a heavy oil (the composition of which is described in Table 3) which had been obtained from coke-oven gas oil, recovered and purified ethylene glycol was mixed, and the resultant mixture was treated in a similar manner as in Example 3, wherein purified indene was obtained. The compositions of the feed, the intermediate, the alkali-washed indene fraction and the purified indene were analyzed. The results are shown in Table 3.

COMPARATIVE EXAMPLE 1

An indene distillate, which had been obtained from coal tar heavy oil and contained 92% of indene and 5.3% of benzonitrile, was subjected to reduced pressure distillation under the same conditions as in Example 1 except that ethylene glycol was not added. The results are shown in Table 1. It is appreciated from the results that the content of benzonitrile in the purified indene was still as high as about 50% of its content in the feed indene and that substantially no effect was observed for the separation of indene and benzonitrile from each other.

COMPARATIVE EXAMPLE 2

P-Cresol was added to an indene distillate which had been obtained from coal tar heavy oil and contained 92% of indene and 5.8% of benzonitrile, and under the same conditions as in Example 1, reduced pressure distillation was conducted. The results are shown in Table 1. It is observed from the results that as in Example 1, the content of benzonitrile in the purified indene decreased relative to that in the feed indene. As p-cresol also forms an azeotrope with indene like ethylene glycol, p-cresol was distilled as an azeotropic distillate fraction. Different from ethylene glycol, however, p-cresol and indene do not undergo phase separation. Accordingly, p-cresol was eliminated by washing the azeotropic distillate fraction with a 10% aqueous solution of sodium hydroxide.

In the following Tables 1 to 3, each distillate rate is based on its corresponding total charge (feed:additive=1:1), and the following abbreviations are used:

BN: benzonitrile

EG: ethylene glycol

DEG: diethylene glycol

TABLE 1

Results of Distillation Test according to the First Aspect of the Invention

| | Comp. Ex. 1 None | | Example 1 EG | | | Example 2 DEG | | | Comp. Ex. 2 p-Cresol | | |
|---|---|---|---|---|---|---|---|---|---|---|---|
| | Indene* | BN* | Indene* | BN* | EG* | Indene* | BN* | DEG* | Indene** | BN** | P-Cresol** |
| Feed | 91.9 | 5.34 | 93.6 | 4.80 | — | 92.1 | 5.83 | — | 92.3 | 5.83 | — |
| 10 | 92.5 | 2.64 | 96.2 | 0.11 | — | 96.2 | 0.21 | — | 69.6 | 0.55 | 26.4 |
| 20 | 95.2 | 2.95 | 96.6 | 0.18 | — | 96.5 | 0.23 | — | 70.2 | 0.56 | 27.2 |
| 30 | 94.1 | 3.10 | 96.9 | 0.32 | 0.004 | 97.1 | 0.28 | — | 71.6 | 0.61 | 27.4 |
| 40 | 94.8 | 3.21 | 97.4 | 0.20 | — | 97.3 | 0.26 | — | 51.4 | 26.5 | 21.0 |
| 50 | 94.1 | 3.28 | | | | | | | | | |
| 60 | 94.3 | 3.33 | | | | | | | | | |
| 70 | 94.2 | 3.41 | | | | | | | | | |
| 80 | 94.0 | 3.62 | | | | | | | | | |
| 90 | 93.4 | 3.74 | | | | | | | | | |

*Only the indene phase of the relevant distillation fraction was collected and analyzed.
**The relevant distillation fraction was analyzed as was, because it did not undergo phase separation.

TABLE 2

(Example 3)
Results of Distillation and Alkali Washing Tests of Heavy oil Derived from Coke-Oven Gas Oil

| | Feed oil (%) | Indene fraction (%) | Alkali-washed indene fraction (%) | Finished distillate (%) |
|---|---|---|---|---|
| Indane | 1.82 | 2.50 | 2.60 | 0.34 |
| Indene | 24.66 | 80.72 | 89.70 | 97.20 |
| Benzonitrile | 4.36 | 0.112 | 0.12 | 0.11 |
| Phenol | 0.76 | 0.805 | — | — |
| o-Cresol | 1.65 | 1.59 | — | — |
| EG (additive) | — | 0.003 | — | — |
| Others | 66.75 | 14.27 | 7.58 | 2.35 |
| Total | 100 | 100 | 100 | 100 |

TABLE 3

(Example 4)
Results of Distillation (with Recycled EG) and Alkali Washing Tests of Heavy oil Derived from Coke-Oven Gas Oil

| | Feed oil (%) | EG fraction (%) | Indene fraction (%) | Alkali-washed indene fraction (%) | Finished distillate (%) |
|---|---|---|---|---|---|
| Indane | 1.81 | — | 2.50 | 2.74 | 0.31 |
| Indene | 25.01 | — | 79.51 | 90.07 | 96.8 |
| Benzonitrile | 4.33 | — | 0.32 | 0.33 | 0.29 |
| Phenol | 0.77 | — | 0.78 | — | — |
| o-Cresol | 1.63 | — | 1.61 | — | — |

TABLE 3-continued (Example 4)
Results of Distillation (with Recycled EG) and Alkali Washing Tests of Heavy oil Derived from Coke-Oven Gas Oil

| | Feed oil (%) | EG fraction (%) | Indene fraction (%) | Alkali-washed indene fraction (%) | Finished distillate (%) |
|---|---|---|---|---|---|
| EG (additive) | — | 91.2 | — | — | — |
| Others | 66.45 | 8.8 | 15.28 | 6.86 | 2.60 |
| Total | 100 | 100 | 100 | 100 | 100 |

[Second Aspect of the Present Invention]

EXAMPLE 5

To an indene distillate which had been obtained from coal tar heavy oil and contained 91% of indene and 6% of benzonitrile, triethylene glycol (TEG) was added, and reduced-pressure distillation was then conducted under the following conditions: reduced pressure: 50 torr, the number of stages: 15, reflux rate: 10. Distillate was collected as 10% fractions based on the total charge. Indene, benzonitrile and triethylene glycol contained in each fraction were quantitated. The results are shown in Table 4. As a result, the content of benzonitrile, which was as high as 6% in the feed, was lowered to 0.6%. In the case of triethylene glycol, this solvent was not distilled together with indene so that indene alone was selectively distilled. It is accordingly understood that triethylene glycol plays a role to suppress distillation of benzonitrile.

EXAMPLE 6

To an indene distillate which had been obtained from coal tar heavy oil and contained 90% of indene and 5.6% of benzonitrile, tetraethylene glycol was added, and reduced pressure distillation was conducted under the same conditions as in Example 5. The results are shown in Table 4. It is appreciated from the results that practically no benzonitrile was contained in the distillate fraction. As tetraethylene glycol was not distilled at all, it is also appreciated that tetraethylene glycol plays a role to suppress distillation of benzonitrile like triethylene glycol in Example 5.

EXAMPLE 7

To a heavy oil (the composition of which is described in Table 5) which had been obtained from coke-oven gas oil, triethylene glycol was added, and reduced pressure distillation was conducted under the same conditions as in Example 5. The thus-obtained indene was washed with an aqueous solution of sodium hydroxide and then with water. The indene was then subjected to atmospheric simple distillation, whereby purified indene was obtained. The compositions of the feed, the indene fraction, the alkali-washed indene fraction and the finished distillate fraction (purified indene) were analyzed. The results are shown in Table 5.

EXAMPLE 8

In a heavy oil (the composition of which is described in Table 6) which had been obtained from coke-oven gas oil, triethylene glycol which had been recovered from a bottoms residual of extractive distillation and then purified was mixed, and the resultant mixture was treated in a similar manner as in Example 7, wherein purified indene was obtained. The compositions of the feed, the indene fraction, the alkali-washed indene fraction and the finished distillate fraction (purified indene) were analyzed. The results are shown in Table 6.

In the following Tables 4 to 6, each distillate rate is based on its corresponding total charge (feed:additive=1:1), and the following abbreviations are used:

BN: benzonitrile

TriEG: triethylene glycol

TEG: tetraethylene glycol

TABLE 4

Results of Distillation Test according to the Second Aspect of the Invention

| | Example 5 TriEG | | | Example 6 TEG | | |
|---|---|---|---|---|---|---|
| | Indene | BN | TriEG | Indene | BN | TEG |
| Feed | 91.4 | 6.00 | — | 90.2 | 5.6 | — |
| 10 | 96.7 | 0.67 | — | 96.8 | 0.22 | — |
| 20 | 97.5 | 0.66 | — | 97.2 | 0.32 | — |
| 30 | 97.3 | 0.71 | — | 98.1 | 0.41 | — |
| 40 | 97.8 | 0.88 | — | 73.0 | 26 | — |

TABLE 5

(Example 7)
Results of Distillation and Alkali Washing Tests of Heavy oil Derived from Coke-Oven Gas Oil

| | Feed oil (%) | Indene fraction (%) | Alkali-washed indene fraction (%) | Finished distillate (%) |
|---|---|---|---|---|
| Indane | 1.78 | 2.40 | 2.50 | 0.33 |
| Indene | 26.01 | 81.14 | 90.10 | 97.50 |
| Benzonitrile | 4.42 | 0.52 | 0.51 | 0.51 |
| Phenol | 0.76 | 0.77 | — | — |
| o-Cresol | 1.66 | 1.59 | — | — |
| TriEG (additive) | — | — | — | — |
| Others | 66.37 | 13.58 | 6.89 | 1.66 |
| Total | 100 | 100 | 100 | 100 |

TABLE 6

(Example 8)
Results of Distillation (with Recycled TriEG) and Alkali Washing Tests of Heavy oil Derived from Coke-Oven Gas Oil

| | Feed oil (%) | TriEG fraction (%) | Indene fraction (%) | Alkali-washed indene fraction (%) | Finished distillate (%) |
|---|---|---|---|---|---|
| Indane | 1.79 | — | 2.60 | 2.60 | 0.30 |
| Indene | 25.78 | — | 78.90 | 89.80 | 96.20 |
| Benzonitrile | 4.43 | — | 0.62 | 0.59 | 0.60 |
| Phenol | 0.79 | — | 0.77 | — | — |
| o-Cresol | 1.61 | — | 1.62 | — | — |
| TriEG (additive) | — | 87.1 | — | — | — |
| Others | 65.60 | 12.9 | 15.49 | 7.01 | 2.90 |
| Total | 100 | 100 | 100 | 100 | 100 |

[Third Aspect of the Present Invention]

EXAMPLE 9

To an indene distillate which had been obtained from coal tar heavy oil and contained 93.4% of indene and 5.65% of benzonitrile, ethylene carbonate (EC) was added, and reduced-pressure distillation was then conducted under the following conditions: reduced pressure: 50 torr, the number of stages: 15, reflux rate: 10. Distillate was collected as 10% fractions based on the total charge. Indene, benzonitrile and ethylene carbonate contained in each fraction were quantitated. The results are shown in Table 7. As a result, the content of benzonitrile, which was as high as 5.65% in the feed, was lowered to 0.22%. In the case of ethylene carbonate, this solvent was not distilled together with indene so that indene alone was selectively distilled. It is accordingly understood that ethylene carbonate has effect as an extractant.

EXAMPLE 10

To an indene distillate which had been obtained from coal tar heavy oil and contained 92.8% of indene and 5.66% of benzonitrile, dimethyl carbonate was added, and reduced pressure distillation was conducted under the same conditions as in Example 9. The results are shown in Table 7. It is appreciated from the results that practically no benzonitrile was contained in the distillate fraction. As dimethyl carbonate was not distilled at all, it is also appreciated that dimethyl carbonate suppresses distillation of benzonitrile like ethylene carbonate in Example 9.

EXAMPLE 11

To a heavy oil (the composition of which is described in Table 8) which had been obtained from coke-oven gas oil, ethylene carbonate was added, and reduced pressure distillation was conducted under the same conditions as in Example 9. The thus-obtained indene was washed with an aqueous solution of sodium hydroxide and then with water. The indene was then subjected to atmospheric simple distillation, whereby purified indene was obtained. The compositions of the feed, the indene fraction, the alkali-washed indene fraction and the finished distillate fraction (purified indene) were analyzed. The results are shown in Table 8.

EXAMPLE 12

In a heavy oil (the composition of which is described in Table 9) which had been obtained from coke-oven gas oil, ethylene carbonate which had been recovered by distillation from a bottoms residual of coal tar distillation and then purified was mixed, and the resultant mixture was treated in a similar manner as in Example 11, wherein purified indene was obtained. The compositions of the feed, the indene fraction, the alkali-washed indene fraction and the finished distillate fraction (purified indene) were analyzed. The results are shown in Table 9.

In the following Tables 7 to 9, each distillate rate is based on its corresponding total charge (feed:additive=1:1), and the following abbreviations are used:

BN: benzonitrile

EC: ethylene carbonate

DMC: dimethyl carbonate

TABLE 7

Results of Distillation Test according to the Third Aspect of the Invention

| | Example 9 EC | | | Example 10 DMC | | |
|---|---|---|---|---|---|---|
| | Indene | BN | EC | Indene | BN | DMC |
| Feed | 93.4 | 5.65 | — | 92.8 | 5.83 | — |
| 10 | 97.2 | 0.22 | — | 96.4 | 0.21 | — |
| 20 | 97.4 | 0.24 | — | 96.7 | 0.23 | — |
| 30 | 97.5 | 0.26 | — | 96.9 | 0.28 | — |
| 40 | 73.0 | 24.0 | — | 61.0 | 0.26 | — |

TABLE 8

(Example 11) Results of Distillation and Alkali Washing Tests of Heavy oil Derived from Coke-Oven Gas Oil

| | Feed oil (%) | Indene fraction (%) | Alkali-washed indene fraction (%) | Finished distillate (%) |
|---|---|---|---|---|
| Indane | 1.72 | 2.38 | 2.42 | 0.32 |
| Indene | 25.80 | 82.40 | 91.20 | 97.10 |
| Benzonitrile | 4.44 | 0.21 | 0.22 | 0.24 |
| Phenol | 0.75 | 0.77 | — | — |
| o-Cresol | 1.62 | 1.56 | — | — |
| EC (additive) | — | — | — | — |
| Others | 65.67 | 12.68 | 6.16 | 2.34 |
| Total | 100 | 100 | 100 | 100 |

TABLE 9

(Example 12) Results of Distillation (with Recycled EC) and Alkali Washing Tests of Heavy oil Derived from Coke-Oven Gas Oil

| | Feed oil (%) | EC fraction (%) | Indene fraction (%) | Alkali-washed indene fraction (%) | Finished distillate (%) |
|---|---|---|---|---|---|
| Indane | 1.77 | — | 2.50 | 2.70 | 0.30 |
| Indene | 24.90 | — | 80.10 | 90.10 | 96.20 |
| Benzonitrile | 5.56 | — | 0.31 | 0.33 | 0.36 |
| Phenol | 0.78 | — | 0.77 | — | — |
| o-Cresol | 1.59 | — | 1.59 | — | — |
| EC (additive) | — | 88.4 | — | — | — |
| Others | 65.4 | 11.6 | 14.73 | 6.87 | 3.14 |
| Total | 100 | 100 | 100 | 100 | 100 |

As has been described above, the present invention brings about the significant advantageous effect that the content of benzonitrile in indene can be significantly lowered.

According to the first aspect of the present invention, the azeotropic distillation of a benzonitrile-containing indene distillate in the presence of a glycol added thereto makes it possible to significantly lower the content of benzonitrile in indene owing to the azeotropic effect of the indene-glycol system.

According to the second aspect of the present invention, the extractive distillation of a benzonitrile-containing indene distillate in the presence of a glycol added thereto makes it possible to significantly lower the content of benzonitrile in indene, because indene alone is distilled while benzonitrile and the glycol remain in a bottoms residual.

According to the third aspect of the present invention, the extractive distillation of a benzonitrile-containing indene distillate in the presence of a particular extractant added thereto makes it possible to significantly lower the content of benzonitrile in indene, because indene alone is distilled while benzonitrile and the glycol remain in a bottoms residual.

What is claimed is:

1. A process for producing indene, which comprises adding a glycol or a derivative thereof to an indene-containing coal tar distillate, and then conducting azeotropic distillation to obtain an indene fraction while eliminating benzonitrile from said indene-containing coal tar distillate.

2. A process according to claim 1, wherein said glycol or said derivative is at least one glycol or derivative selected from the group consisting of ethylene glycol, diethylene glycol, propanediol, butanediol and derivatives thereof.

3. A process for producing indene, which comprises adding a glycol or a derivative thereof to an indene-containing coal tar distillate, and then conducting extractive distillation to obtain an indene fraction while eliminating benzonitrile from said indene-containing coal tar distillate.

4. A process according to claim 3, wherein said glycol or said derivative is at least one glycol or derivative selected from the group consisting of triethylene glycol, tetraethylene glycol and derivatives thereof.

5. A process for producing indene, which comprises adding to an indene-containing coal tar distillate an extractant selected from the group consisting of dialkyl carbonates, alkylene carbonates and diaryl carbonates, and then conducting extractive distillation to obtain an indene fraction while eliminating benzonitrile from said indene-containing coal tar distillate.

6. A process according to claim 5, wherein said extractant is at least one extractant selected from the group consisting of dimethyl carbonate, ethylene carbonate and propylene carbonate.

* * * * *